US008310329B1

(12) United States Patent
Herbert

(10) Patent No.: US 8,310,329 B1
(45) Date of Patent: Nov. 13, 2012

(54) INTERLEAVED COMMON MODE TRANSFORMER WITH COMMON MODE CAPACITORS

(76) Inventor: Edward Herbert, Canton, CT (US)

( * ) Notice: Subject to any disclaimer, the term of this patent is extended or adjusted under 35 U.S.C. 154(b) by 0 days.

(21) Appl. No.: 13/118,676

(22) Filed: May 31, 2011

Related U.S. Application Data

(60) Provisional application No. 61/349,289, filed on May 28, 2010.

(51) Int. Cl.
*H01F 5/00* (2006.01)
*H01F 27/28* (2006.01)

(52) U.S. Cl. ..... 336/200; 336/186; 336/187; 336/232

(58) Field of Classification Search ..... 336/69, 336/137, 145, 147, 186, 187, 200, 232
See application file for complete search history.

(56) References Cited

U.S. PATENT DOCUMENTS 3,403,323 A * 9/1968 Wanlass ..... 323/250
3,409,805 A * 11/1968 Whipple et al. ..... 361/784
3,443,198 A * 5/1969 Wanlass ..... 363/75
3,489,920 A * 1/1970 Fritz et al. ..... 327/82
3,582,829 A * 6/1971 Wanlass ..... 332/117
5,500,632 A * 3/1996 Halser, III ..... 336/180
5,521,573 A * 5/1996 Inoh et al. ..... 336/180
5,642,276 A * 6/1997 Lotfi et al. ..... 363/144
5,982,263 A * 11/1999 Bouillot et al. ..... 336/185
7,019,994 B2 * 3/2006 Elgert et al. ..... 363/82
7,149,096 B2 * 12/2006 Batarseh et al. ..... 363/16
7,439,839 B2 * 10/2008 Podlisk et al. ..... 336/200
7,502,234 B2 * 3/2009 Goliszek et al. ..... 363/17

* cited by examiner

*Primary Examiner* — Mohamad Musleh
*Assistant Examiner* — Joselito Baisa

(57) ABSTRACT

The interleaved common mode transformer is a transformer particularly well suited for providing low voltage, high current dc outputs. Improving the efficiency of low voltage, high current transformer circuits requires a multi-faceted approach. Ac terminations and ac currents in connecting circuitry are particularly troublesome, so the input and output terminations of the transformer are dc. To utilize the winding fully, a common-mode push-pull configuration with common mode capacitors is used. Stray capacitance is less of a concern than leakage inductance at low voltages, so the windings are highly interleaved. Separate parallel secondary windings are used, an ac winding primarily for the ac currents, and a dc winding primarily for dc currents and heat sinking. The ac windings are thin; approximately two times the penetration depth. The dc windings are substantial, for low voltage drop and good heat sinking. For economical construction with minimum height, plated circuit board fabrication methods and materials are used for the windings. 100 percent duty-ratio switching is preferred to minimize core losses and reduce filtering requirements, as the filters are lossy.

1 Claim, 10 Drawing Sheets

INTERLEAVED COMMON MODE TRANSFORMER WITH COMMON MODE CAPACITORS

CROSS-REFERENCE TO RELATED APPLICATIONS

This application is a continuation-in-part application of a provisional U.S. patent application Ser. No. 61/349,289, filed May 28, 2010 entitled "Interleaved Current Doubler with Common Mode Capacitors." Priority is claimed to its filing date, and this application is included herein by reference.

Reference is made to a provisional U.S. patent application Ser. No. 61/488,721 filed May 21, 2011 and entitled "Minimalized Power Converter." Priority is claimed to its filing date, and this application is included herein by reference.

BACKGROUND OF THE INVENTION

Designing a low voltage, high current, high frequency transformer is particularly challenging because the high currents aggravate proximity effects, and the low voltage provides little driving force to change the currents through the stray and leakage inductances of the transformer and its associated circuitry.

Reference is made to a tutorial, "Design and Application of Matrix Transformers and Symmetrical Converters", by Edward Herbert, a seminar presented at the Fifth International High Frequency Power Conversion Conference '90, Santa Clara, Calif., May 11, 1990.

SUMMARY OF THE INVENTION

Improving the efficiency low voltage, high current transformer circuits requires a multi-faceted approach.

1. Ac terminations and ac currents in circuitry are particularly troublesome, so the input and output terminations of the transformer are dc.
2. To utilize the winding fully, a common-mode push-pull configuration with common mode capacitors is used. Common mode gate drivers are used for the MOSFET rectifiers so that the drivers are ground referenced.
3. A full-wave bridge circuit often is the preferred derectifier for a higher voltage dc input. However, high side drivers for conventional full-wave bridge circuits are complex and lossy. A full-bridge with common mode capacitors is used so that the MOSFET switches are ground-referenced.
4. Stray capacitance is less of a concern than leakage inductance at low voltages, so the ac windings are highly interleaved.
5. The ac windings are thin; approximately two times the penetration depth. The dc windings are substantial, for low voltage drop and good heat sinking.
6. For economical construction with minimum height, plated circuit board fabrication methods and materials are used for the windings. To avoid the expense of a large multi-layer printed wiring board, winding sub-assemblies with many layers are installed on printed wiring boards having fewer layers as any component would be.
7. Layer to layer interconnections within the transformer are on the vertical surfaces of the transformer, so plated through holes (vias) are not needed. This uses much less of the winding volume.
8. 100 percent duty-ratio switching is used to minimize core losses and reduce filtering requirements, as the filters are lossy.

9. To minimize the length of ac conductors, and thus to minimize their stray inductance, the capacitors and/or the switching semiconductors such as MOSFETs can be mounted on the transformer.
10. For optimum heat-sinking, shielding and/or for making connections to components, a nearly continuous overlay of plated copper can be used.
11. To reduce cross-over power, the gate drive for turn off exceeds the drain current and is very fast. The gate low-side drivers for fast turn-off are on or very near the MOSFETs.
12. To ensure zero-volt turn-on, the turn-on gate drive is somewhat slower. To reduce die complexity, the turn-on gate drive is not on the die.

Enabling technology for this invention is the use of controlled lasers to expose photo-resists, either positive or negative as required, for making printed wiring boards. This can be adapted to allow "printing" conductors on vertical surfaces of the transformer.

BRIEF DESCRIPTION OF THE DRAWINGS

FIG. 4 shows one polarity of excitation and FIG. 5 shows the other polarity of excitation.

FIG. 37 shows one polarity of excitation; FIG. 38 shows the other.

DETAILED DESCRIPTION

Figure 1:
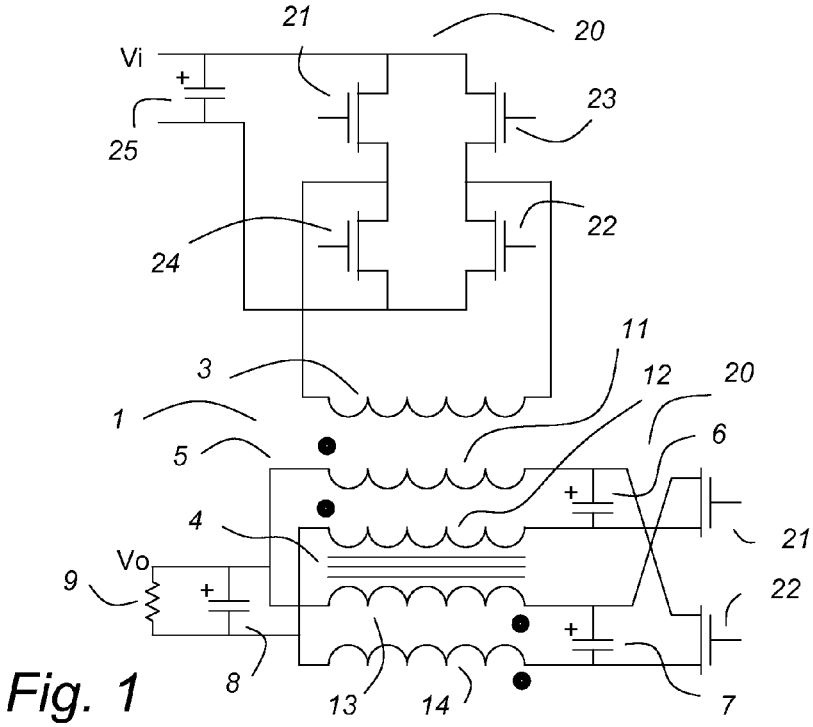
FIG. 1 shows a schematic of an interleaved common mode transformer. The primary excitation is a full-bridge derectifier from a dc voltage source.

In the drawings, the same reference designator indicates the same part. In some instances, one figure may show a part in schematic diagram and another may show a more physical drawing of the same part using the same reference designator.

FIG. 1 shows a representative schematic of a common-mode transformer with common mode capacitors. A transformer 1 comprises a primary winding 3, a transformer core 4 and a secondary winding 5 comprising four windings 11-14. Attached to the secondary winding 5 are common mode capacitors 6 and 7 and cross-coupled switches 21 and 22, shown as MOSFETs, as an example, not a limitation. There may be an output filter capacitor 8 and a load 9, shown as a resistor.

The primary winding 3 may be excited from an ac voltage source, but FIG. 1 shows that the excitation may be from a dc voltage source Vi and a derectifier 20 comprising four switches 21-14, shown as MOSFETs as an example, not a limitation. There may be an input filter capacitor 25.

Many of the problems of low voltage, high current transformers are attributable to large ac currents in the terminations. Accordingly, the ac currents are internalized within the transformer and only dc current is brought to the terminals. The dc winding is short and has substantial copper area, for low voltage drop and good heat sinking.

Figure 2:
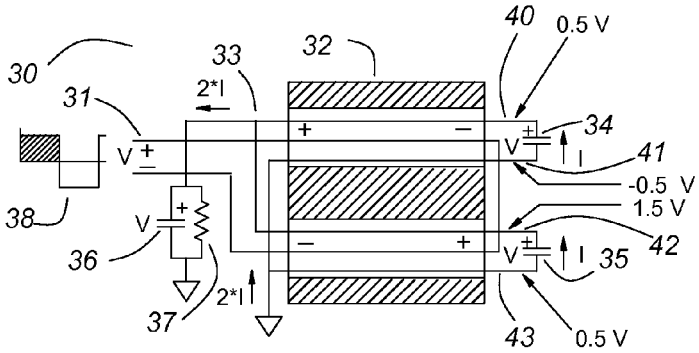
FIG. 2 shows the primary and secondary windings only of an interleaved common mode transformer, with only the dc mode shown for the secondary winding, for one polarity of excitation.

FIG. 2 shows a common mode common-mode transformer 30 and illustrates the flow of dc output currents for one polarity of excitation, the polarity of excitation being shown by the shading in a small graph 38 and the + and – signs on the input of a primary winding 31. There are two branches of a dc secondary winding 33, one through each side of a transformer core 32, comprising respectively the windings 40 and 41 and the windings 42 and 43, connecting respectively, two common mode capacitors 34 and 35 to the output load 37, shown as a resistor, as an example, not a limitation. There may be a output filter capacitor 36. In FIG. 2, the primary winding 31 makes a single turn through the transformer core 32. Usually, the primary winding 31 would have many turns, but one turn being shown as it is adequate to explain the theory and it keeps the drawing simpler. Any flux change in the transformer core 32 and any state of the primary winding 31 induce only common mode voltages in the windings 40-43 as shown by the + and – signs within the transformer core 32, and therefore have no direct influence on the voltages V of the common mode capacitors 34 and 35. Their voltage V is the same as the voltage V of the output to the load 37 and the filter capacitor 36. To demonstrate, as an example, a single turn of a primary winding having one volt per turn is shown, with one polarity shown in FIG. 2. The voltages at several nodes are also shown.

Figure 3:
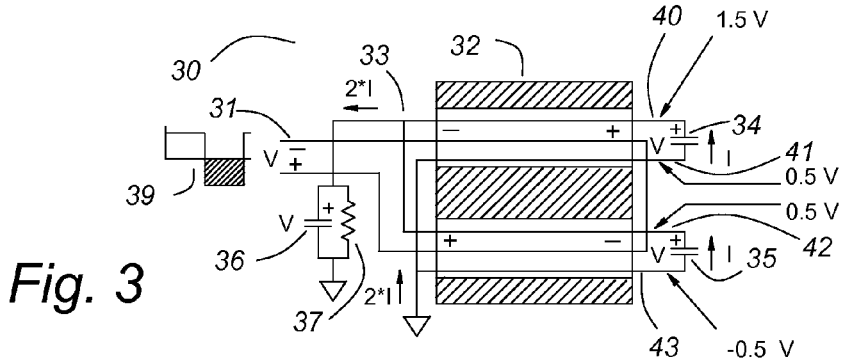
FIG. 3 is the same, except the polarity of excitation is opposite.

FIG. 3 shows the same common mode common-mode transformer as in FIG. 2, except the polarity of the primary winding 31 has reversed as shown by a small graph 39 and the + and – signs at the input of the primary winding 31. As in FIG. 2, the induced voltages are common mode for the dc circuits from the capacitors 34 and 35 to the output load 37.

As seen in FIGS. 2 and 3, the two branches of the dc secondary winding 33 comprising respectively the windings 40 and 41 and the windings 42 and 43, and each are shown conducting a current I. The currents add as 2*I at the load 37. The total current, shown as 2*I is determined by the impedance of the load 37 and its voltage V. The source of the current in FIGS. 2 and 3 is the common mode capacitors 34 and 35, and the current will divide equally as shown only if the voltages V are equal and the impedances in each branch of the secondary winding 33 are equal.

For the dc analysis of the dc current flow in FIGS. 2 and 3, no continuous secondary winding around the transformer core 32 is shown, so the current in the primary winding 31 is zero (neglecting the magnetization current). There is no mechanism shown to recharge the common mode capacitors 34 and 35, as that is discussed in FIGS. 4 and 5.

The rationale for dividing the discussion is that this invention teaches that the ac windings and the dc windings will be separate due to the different characteristics of dc conduction and high frequency ac conduction. In the ac circuits, sine-wave excitation or pulse-width-modulated (pwm) excitation certainly is possible, but the focus is on square-wave excitation operating at 100 percent duty-ratio, as that produces a clean dc when rectified, with little filtering needed. Filters are bulky and lossy, so minimizing them is preferred. Also, the rms currents are lower for the same output power with a square-wave.

In a dc circuit, the dc current follows the path of least resistance. In an ac circuit, the ac current follows the path of least impedance, primarily the least inductance. High frequency ac currents in a conductor are limited by the penetration depth, and this is particularly so with square-wave ac, as the third and fifth harmonics are important, though diminishing in amplitude. If there is a thick winding, the ac currents will flow only on the surface even if the resistance is very low. Accordingly, as will be shown below, the ac windings are very thin printed wiring foils. To reduce the inductance, they are highly interleaved. On the other hand, thick conductors work well for dc currents and also are excellent for heat sinking.

While "ac windings" and "dc windings" are discussed separately, some component of the ac current will flow on the surfaces of the dc windings, and some component of the dc current will flow in the ac windings. When ac currents and dc currents superpose on the same winding, often current flow in one direction they will cancel only to double in the other direction. When doubled, the loss is as the square, or four times. When canceled, the loss, of course, is zero, but the net increase loss is doubled. The asymmetry of losses also means the voltage drops are asymmetrical, so flux walking may be a concern.

In high frequency transformers, among the most troublesome part of the transformer is the ac terminations. To the greatest extent, these are internalized within the transformer in this invention. By providing a heavy copper, very low resistance dc current path, much of the dc current is kept out of the ac windings, reducing the losses. In addition, the heavy copper provides excellent heat sinking.

In FIGS. 1 through 7, single turn undifferentiated windings are shown for the secondaries, to keep the drawings simple. By dividing the drawings so that some show the dc conduction and others show the ac conduction, both are explained with simple drawings, it being understood that although illustrated separately, they do superpose if there is a single winding.

Figure 4:
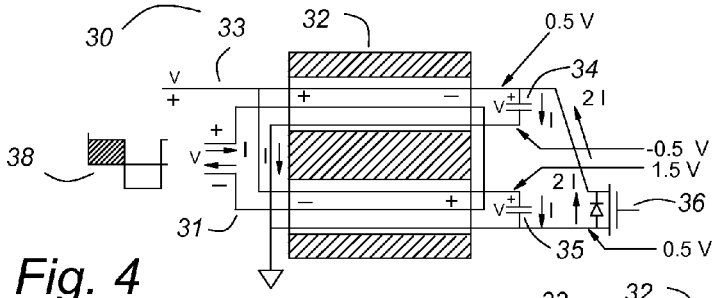
FIGS. 4 and 5 show the same transformer as in FIGS. 2 and 3, with only the ac mode shown for the secondary windings.
Figure 5:
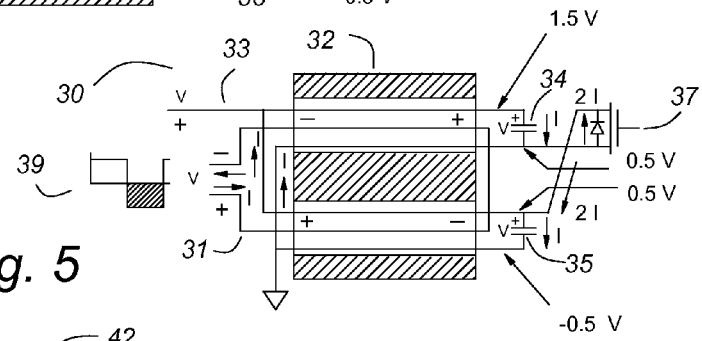

FIGS. 4 and 5 show the same common mode common-mode transformer 30 as shown in FIGS. 2 and 3, with the addition of secondary switches 36 and 37, shown as MOSFETs, as an illustration, not a limitation. These switches 36 and 37 are analogous to the switches 21 and 22 of FIG. 1, and both are present but only the switch 36 or 37 that is turned on is shown respectively in FIGS. 4 and 5. There is no load, so there is no dc output current.

FIG. 4 shows a positive polarity of primary excitation, as shown by the small graph 38 and the + and – signs on the input of the primary winding 31. For positive excitation, the switch 36 is turned on, and the current flow is as shown. FIG. 5 shows negative polarity of primary excitation, and the switch 37 is turned on. For each polarity of excitation, the current flow is as shown by arrows, but the important point is that the current charging the common mode capacitors 34 and 35 is the same in FIGS. 4 and 5. The turned on switches 36 or 37 essentially place the common mode capacitors 34 and 35 in series, first in one order, then the other.

Note that the currents in the capacitors 34 and 35 are equal but opposite in FIGS. 2 and 3 versus FIGS. 4 and 5. To the extent that they truly are equal and opposite, they cancel, and the common mode capacitor currents net to zero, as they must to conserve charge and maintain a constant voltage V. The common mode capacitors may provide significant current during the switching times of the switches 36 and 37, and that current will be made up during the respective on times.

Zero switching time is the ideal, and it is preferred that the switching time be as short as possible. With a conventional transformer, very fast switching time may lead to high spiking due to stray and leakage inductance of the transformer and the circuit. The common mode capacitors 34 and 35 effectively decouple the switches 36 and 37 from the stray and leakage inductance except for the very small portion of the circuit interconnecting the common mode capacitors 34 and 35 to the switches 36 and 37. Therefore this circuit enables extremely fast switching times, sufficiently fast that crossover power can be substantially reduced and the notch due to the dead-time during switching that must be filtered in the dc output is very small.

Figure 6:
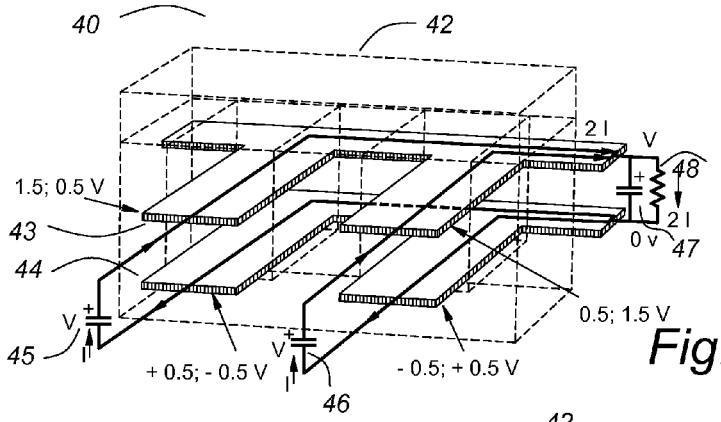
FIG. 6 is diagrammatic, not literal, and shows the dc current flow in dc secondary windings in a transformer with common mode capacitors.

FIG. 6 is a diagrammatic drawing of a common mode common-mode transformer transformer 40 showing in phantom a transformer core 42, shown as an E-I core as an illustration, not a limitation. Common mode secondary windings 43 and 44 couple to common mode capacitors 45 and 46. The currents are shown by arrows, and the currents flow from the common mode capacitors 45 and 46 to a load 48, shown as a resistor, as an example, not a limitation. There may also be an output filter capacitor 48.

Figure 7:
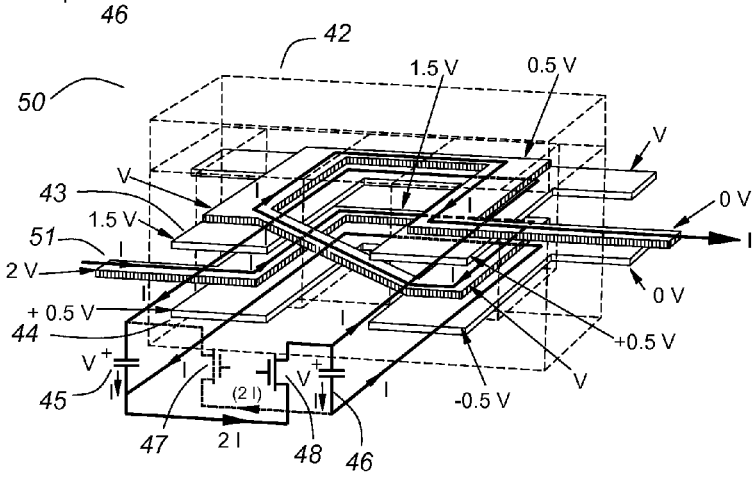
FIG. 7 is diagrammatic, not literal, and shows the transformer of FIG. 6 with a primary winding added, and shows the ac current flow in ac windings of a transformer with common mode capacitors.

In FIG. 7, a two-turn primary winding 51 is added to the common mode transformer 40 of FIG. 6 to make a common mode transformer 50. There is no load shown in FIG. 7, and, as in FIGS. 4 and 5, the ac currents charging the common mode capacitors 45 and 46 are shown for one polarity of the primary excitation. In FIG. 7, a switch 48, shown as a MOSFET, as an example, not a limitation, is turned on. A second switch 47 is turned off, and it and its connections carrying no current are shown with dashed lines. For opposite polarity excitation, the switch 47 is turned off. The switch 48 is turned on and carries a current 2I as shown in parentheses.

Figure 8:
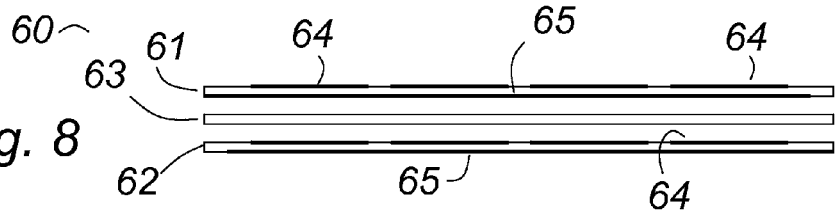
FIGS. 8 through 15 show progressive steps in making printed wiring transformer windings using this invention.

FIGS. 8 through 18 show how the primary winding and the ac and dc secondary windings for a common mode transformer may be made using multi-layer printed wiring board techniques by illustrating representative cross sections through the windings or portions thereof. FIG. 8 shows a stack section through a stack of laminates 60 comprising two etched laminates 61 and 62 and a layer of insulation 63. The two etched laminates 61 and 62 may have etched thereon primary winding turns 64-64 and secondary winding turns 65-65, shown arbitrarily for illustration of the manufacture method without description of the numbers of turns of the windings or their interconnections, as those design details are determined by the specific application. When the layer of insulation 63 is partly cured, it commonly called a "prepreg" and it may be used to bond the other layers into a multi-layer printed wiring board.

Figure 9:
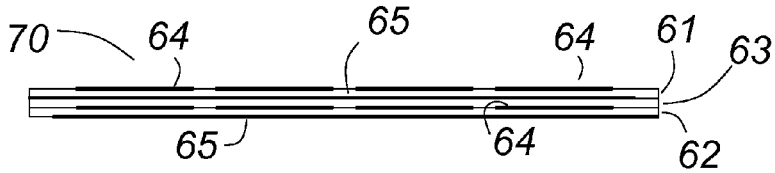

FIG. 9 shows a section through a cured stack of laminates 70 comprising the etched laminates 61 and 62 and the now cured insulation layer 63 of FIG. 8. While thicker stacks of more laminates and insulation may be stacked at once, it is contemplated that the stack 70 may be a useful sub-assembly and that connections between windings may be made at the edges. Each winding stack of laminates 70 is small, but it is contemplated that many similar subassemblies may be made in a single large lamination for easy handling and batch processing, to be cut apart as necessary and stacked for subsequent assembly.

Figure 10:
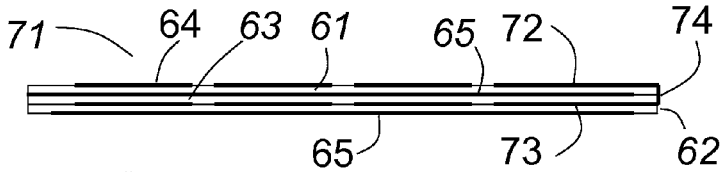

FIG. 10 shows a different section 71 through the same stack of laminates 70 of FIG. 9. Two turns 72 and 73 of the primary winding 64-64 of FIGS. 8 and 9 are connected layer to layer by a plated edge connection 74. The primary turns 72 and 73 are modified turns 64-64 of FIGS. 8 and 9 having tabs extending to the surface so that connection is made to the plated edge connection 74. In other locations, the primary turns 72 and 73 have edge margins as do the turns 64-64 of FIGS. 8 and 9 to insulate them from other connections at the edge.

It is contemplated that the plated edge connection 74 is made using the familiar processing steps for making plated through holes or vias in a printed wiring board. The stack of laminates 71 is seeded with a thin conductive layer, usually by electroless deposition, as an illustration, not a limitation, though sputtering, vapor deposition and other methods can be used and are equivalent for this invention. Once a thin conductive layer is established, copper is plated on it to the desired thickness. A photo-resist is then applied and exposed to light to establish a connection pattern and other copper areas that are to remain. The stack of laminates 71 is then etched to remove copper in other areas. Although vias are usually in drilled holes, there is no reason why they cannot be at an exposed edge of the laminate, including the sides, ends and cut-outs as well.

Enabling technology for this invention is the use of controlled laser light to expose photo-resists, as conventional screen printing or light exposure using flat masks are not useful for exposing vertical surfaces. Controlled laser light can expose sections of the photo-resist without requiring masks. This not only enables exposing photo-resist on vertical surfaces, it makes it easy to customize the etching pattern and interconnections of a transformer with changes easily made within a production run. This makes it relatively economical to make a one or a small number of transformer windings of one design while a batch of transformer windings are being made.

Figure 11:
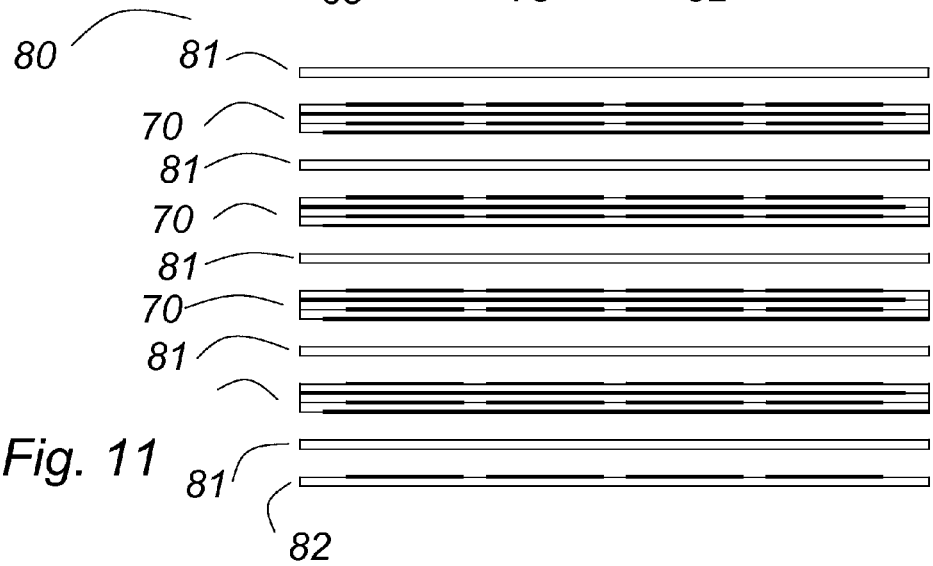
Figure 12:
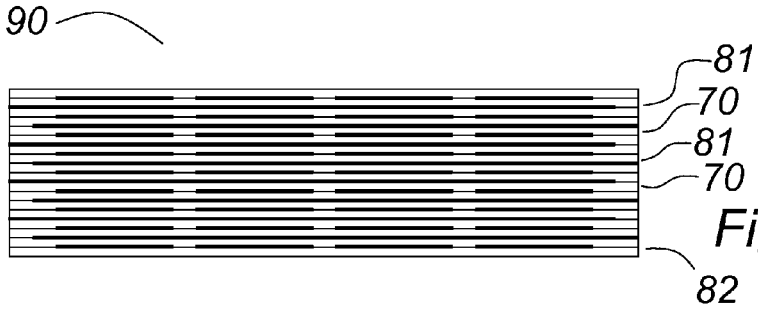

FIG. 11 shows a stack of laminates 80 before assembly and bonding comprising a plurality of stacks of laminates 70 of FIG. 9 with layers of insulation 81 between them and on the top. A special laminate 82 shows that a variety of laminates may be needed for the design of individual common mode transformers. FIG. 12 shows a stack of laminates 90, which is the stack of laminates 80 of FIG. 11 after compression and cure to bond the layers together.

Figure 13:
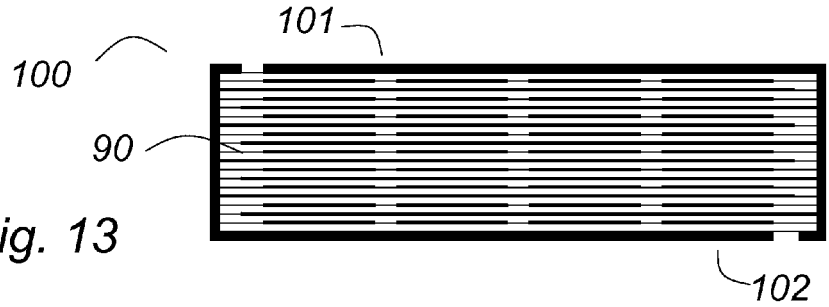

FIG. 13 shows a stack of laminates 100 that is the stack of laminates 90 of FIG. 12 further comprising surface plating 101 and 102 used to establish edge connections to the windings as necessary and to provide a heavy conduction path for the dc currents and heat.

It is contemplated that the surface plating 101 and 102 is made using the familiar processing steps for making plated through holes or vias in a printed wiring board. The stack of laminates 90 is seeded with a thin conductive layer, usually by electroless deposition, though sputtering, vapor deposition and other methods are equivalent for this invention. Once a thin conductive layer is established, copper is plated on it to the desired thickness. A photo-resist is then applied and exposed to light to establish a connection pattern and other copper areas that are to remain. The stack of laminates 100 is then etched to remove copper in other areas. Although vias are usually in drilled holes, there is no reason why connections and large conductive surfaces cannot be made as well using the same process.

Again, exposing the photo-resists with controlled laser light is enabling technology for this invention, as conventional screen printing and flat masks are not useful for exposing photo-resist on vertical surfaces.

Figure 14:
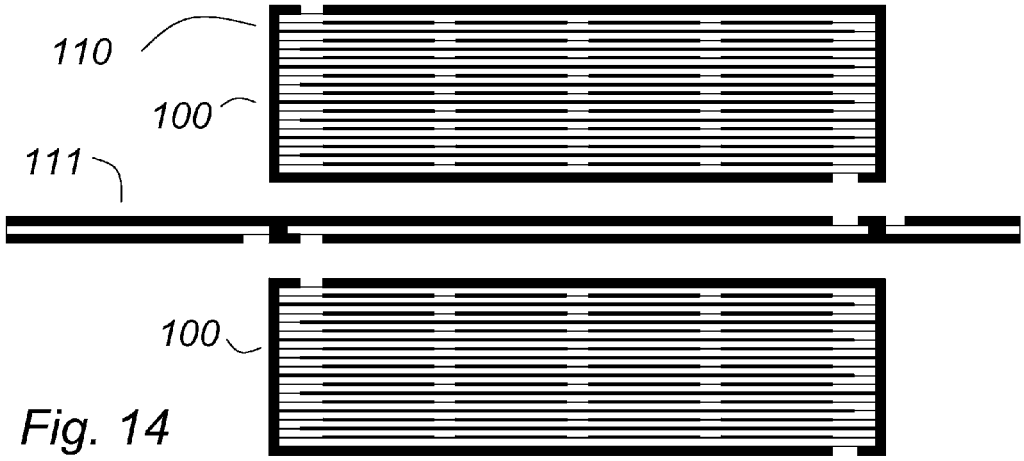
Figure 15:
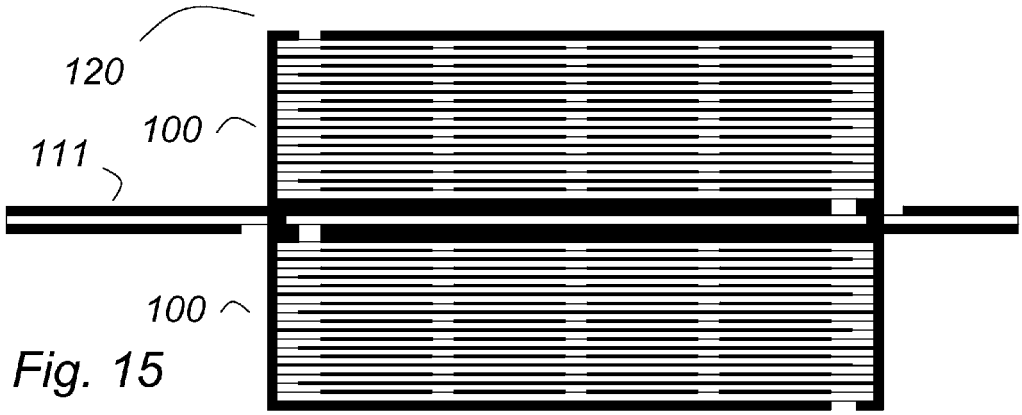

FIG. 14 shows that a winding 110 for a common mode transformer is made by mounting two stacks of laminates 100 of FIG. 13 on a printed wiring board 111. In FIG. 14, the stacks of lamination 100 are in position but not yet bonded to the printed wiring board 111. FIG. 15 shows a winding 120 for a common mode transformer that is the winding 110 of FIG. 14 after bonding. There are alternative methods of bonding assemblies to printed wiring boards, but soldering is contemplated for its structural integrity and good conduction of heat and electricity. Other methods of bonding such as conductive epoxy as an example, not a limitation are equivalent for the teachings of this invention.

FIGS. 14 and 15 show using identical stacks of laminates 100 on the top and bottom of the circuit board 111. While that is preferred, many designs will require top and bottom stacks of lamination that differ in some respect.

Figure 16:
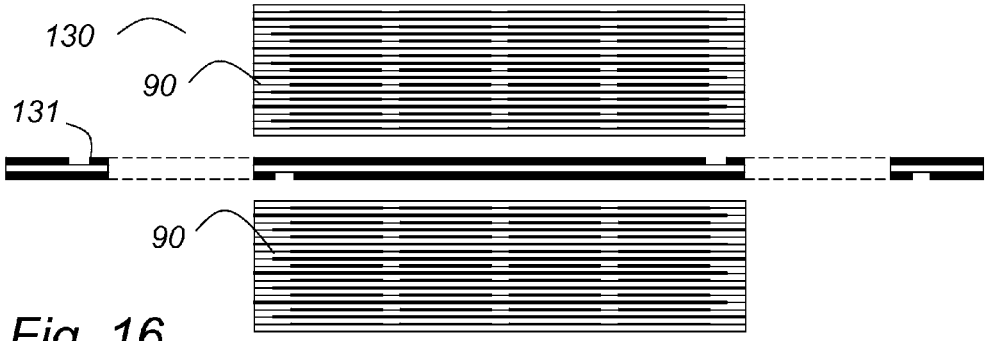
FIGS. 16 through 18 show some modified steps in making an alternate embodiment of printed wiring transformer windings of this invention.

FIG. 16 shows an alternate sequence for making a winding 130 for a common mode transformer. Two stacks of laminates 90-90 are positioned for bonding to a printed wiring board 131. The laminates 90-90 may be the stack of laminates 90 of FIG. 12.

Figure 17:
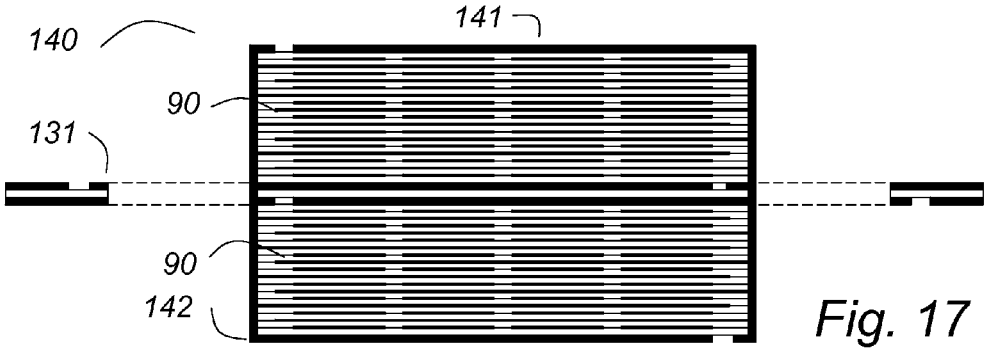

FIG. 17 shows a winding 140 for a common mode transformer which is the winding 130 of FIG. 16 after bonding. The winding 140 further comprises surface plating 141 and 142 used to establish edge connections to the windings as necessary and to provide a heavy conduction path for the dc currents and heat. In contrast to FIG. 15, this method avoids plating the sub-assemblies 90-90 prior to bonding to the printed wiring board 131 but requires it afterwards. It is possible that some applications may plate some interconnections at the sub-assembly level and others at the board level. All are equivalent for this invention and which method to use is a trade-off of the design for specific applications.

It is contemplated that the surface plating 141 and 142 is made using the familiar processing steps for making plated through holes or vias in a printed wiring board. The stack of laminates 90 and the printed wiring board 131 is seeded with a thin conductive layer, usually by electroless deposition, though sputtering, vapor deposition and other methods are equivalent for this invention. Once a thin conductive layer is established, copper is plated on it to the desired thickness. A photo-resist is then applied and exposed to light to establish a connection pattern between turns of the winding 140 and to the printed wiring board 131 and other copper areas that are to remain. The winding 140 is then etched to remove copper in other areas. Although vias are usually in drilled holes, there is no reason why connections and large conductive surfaces cannot be made as well using the same process.

Figure 18:
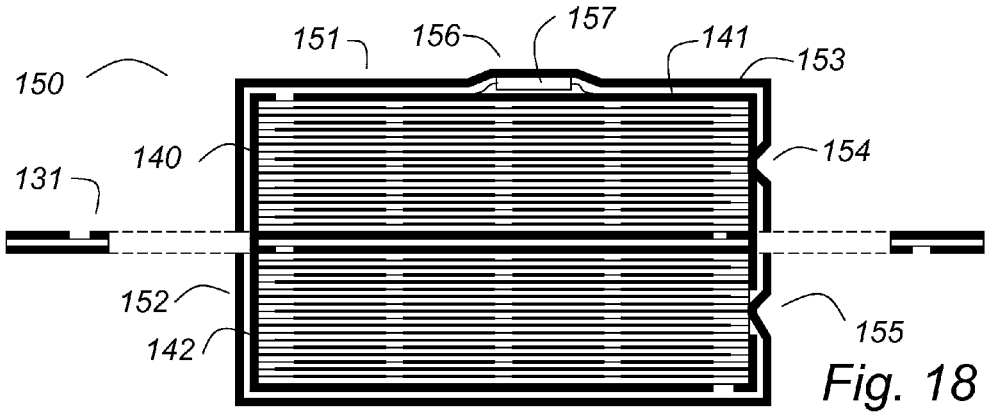

FIG. 18 shows a winding 150 for a common mode transformer which is the winding 140 of FIG. 17. The winding 150 further comprises second layers of surface plating 151 and 152. An insulating film 153 is first deposited upon the winding 140 of FIG. 17. The insulating film may be deposited selectively or etched as necessary to enable connections 154 and 155 through the insulating layer 153. Any number of similar additional layers of surface plating upon additional layers of insulation may be used, but the second is contemplated for some applications because the first layers of surface plating 141 and 142 may largely comprise vertical connections and lack the horizontal continuity for lateral electrical conduction and good heat transfer. The second layer of surface plating 151 and 152 may serve that purpose.

A continuous conductive surface layer may also help contain emi by serving as a shield, and may provide a sealing layer excluding environmental contamination. As an example, parylene is an excellent insulation but it is subject to oxidation at elevated temperatures if exposed to air. It is also contemplated that components may be mounted on the surface of a winding for a common mode transformer, perhaps using a foot-print pattern established on a first plated layer. With under-sealing and a subsequent layer of insulation, a second layer of copper can be plated on top of the components and the winding. If the components are insulated from the second layer of copper, it provides very well coupled heat sinking. If the components are not insulated entirely, the second layer of copper can provide electrical connections as well. This may be very advantageous for making a low impedance connection to the back of a vertical MOSFET, as an example, not a limitation.

FIG. 18 shows a component 157 mounted on the first conductive layer 141. The second conductive layer 151 has a protrusion 156 enclosing the component 157 and making electrical contact to the top surface thereof. As FIG. 18 is a section, the interconnection pattern in the first conductive layer 141 comprising the footprint for the component 157 is not shown but would be understood by one skilled in the art of printed wiring. A number of components could be similarly installed, and more conductive layers with selective etching and interconnections may be needed to properly connect them. The components may be on the surface of the windings and not enclosed by a subsequent conductive layer. The design of printed windings for common mode transformers is very flexible once its teachings are applied.

In FIGS. 14 through 18, the windings for a common mode transformer are shown with identical laminate stacks 90 or 100 on the top and bottom of the printed wiring boards 111 or 131. It is an objective to use identical laminate stacks, but it is entirely possible that they will be different. The windings themselves may be different or they may be the same except differently connected using different surface connections, or different patterns may be etched on their surfaces for connecting to different components. All are contemplated as different embodiments of this invention.

Figure 19:
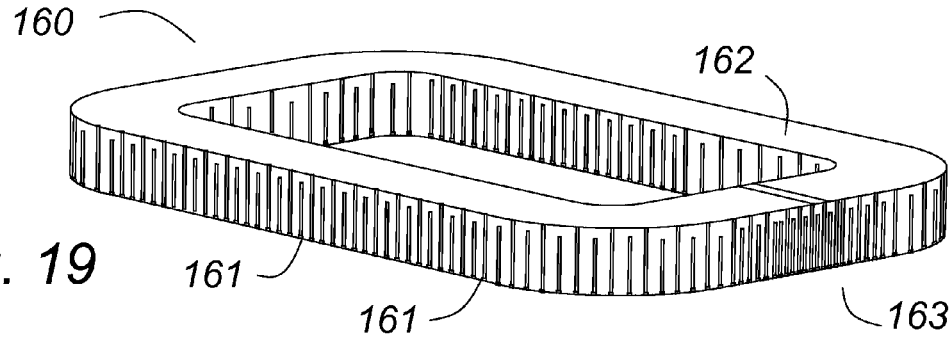
FIGS. 19 through 21 show perspective views of an alternate embodiment of printed wiring transformer windings of this invention.

FIG. 19 shows a perspective view of a winding 160 for a common mode transformer. Conductors 161-161 are plated on its vertical surfaces. A continuous conductor 162 may be plated on its top surface, though it must be interrupted in at least one place so as not to short-circuit the flux of the common mode transformer. The conductor pattern will very likely vary around the winding 160, as shown by a conductor pattern 163.

Figure 20:
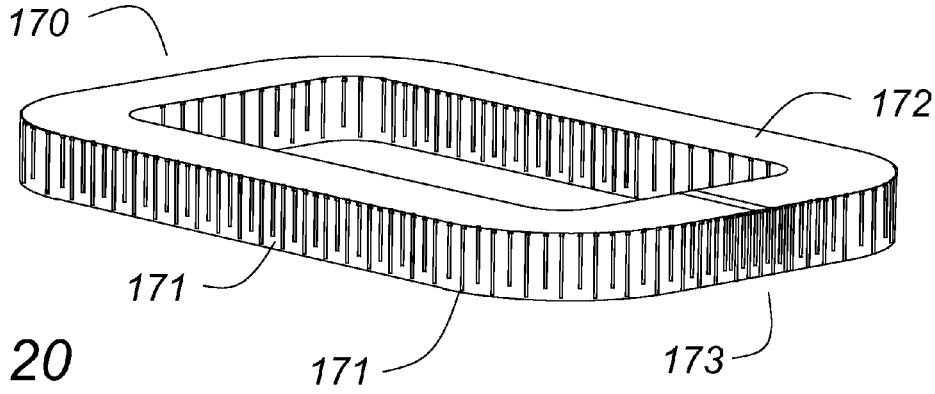

FIG. 20 shows a perspective view of a winding 170 for a common mode transformer. Conductors 171-171 are plated on its vertical surfaces. A continuous conductor 172 may be plated on its top surface, though it must be interrupted in at least one place so as not to short-circuit the flux of the common mode transformer. The conductor pattern will very likely vary around the winding 170, as shown by a conductor pattern 173.

Figure 21:
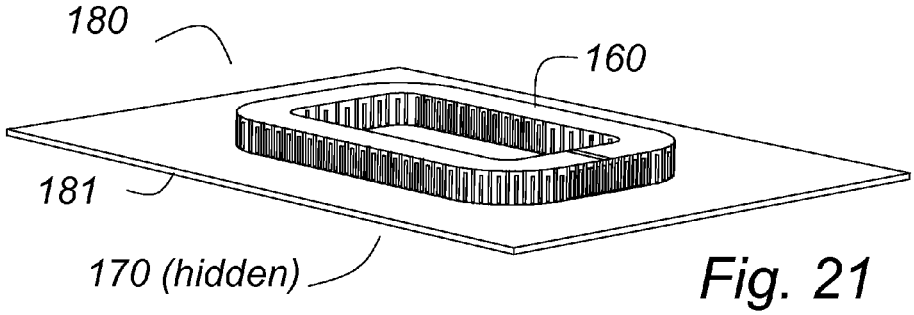

It is contemplated that the windings 160 of FIGS. 19 and 170 of FIG. 20 are subassemblies to make a winding 180 for a common mode transformer as shown in FIG. 21. The winding 160 is shown mounted on a printed wiring board 181, and it is understood that the winding 170 is mounted on the bottom surface of the printed wiring board 181, hidden from view. The printed wiring board 181 will have cutouts cut therein to receive a transformer core, and the winding may or may not have subsequent conductive layers deposited and etched thereon.

Figure 22:
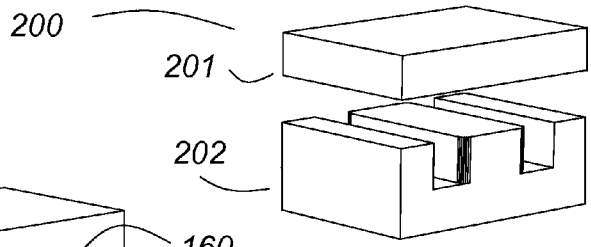
FIG. 22 shows a representative transformer core.

FIG. 22 shows a representative transformer core 200 comprising an E-I core as an example, not a limitation. An I-section 201 mates with an E-section 202.

Figure 23:
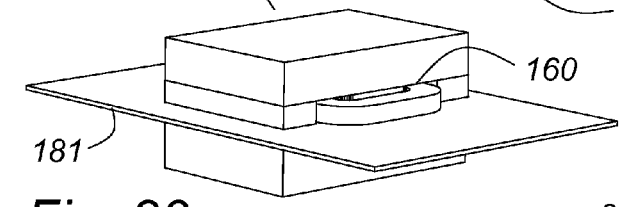
FIG. 23 shows the same core with a transformer winding.

FIG. 23 shows common mode transformer 210 comprising a transformer core 200 and a printed wiring winding 180 comprising a stack of laminates 160 bonded to a printed wiring board 181, with reference to FIG. 21. Although a common mode interleaved transformer may be made with one stack of laminates 160 on a printed wiring board 181 as shown in FIG. 23, it is contemplated that a second stack of laminates is on the bottom of the printed wiring board 181, hidden from view.

A point of novelty of the invention is that lamination subassemblies with many layers can be applied to a simple printed wiring board to make a "planar" transformer. The complexity of many layers is limited to the small sub-assemblies, allowing a simple printed wiring board. Another point of novelty is plating connections on the vertical surfaces of the transformer. As an alternative method, the entire printed wiring board may have as many layers as needed to define a winding. A few layers may be interconnected on sub-assemblies as in FIG. 10, and the multi-layer printed wiring board may have cutouts therein to receive one or more transformer cores. The vertical surfaces of the cutouts may be plated and etched as in FIGS. 13, 17 and 18 to interconnect the internal layers of the winding as needed.

Figure 24:
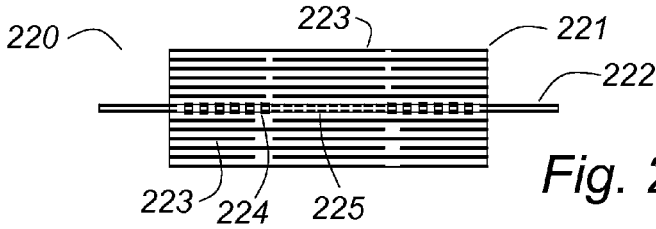
FIG. 24 shows the switch end of an interleaved common mode transformer prior to plating the vertical interconnections.

FIG. 24 is a representative end view of a common mode transformer winding 220 prior to plating and etching the vertical conductors. A stack of laminates 221 is bonded to a printed wiring board 222. The stack of laminates 221 has a plurality of conductor foils 223-223. The printed wiring board 222 may have a plurality of vias 224 and surface mount pads 225 which will be contiguous with vertical conductors to be added by plating and etching. Noteworthy is that the plurality of conductor foils end in a staggered pattern so that there is overlap in the center to facilitate very short connections to switches that may subsequently be mounted on the printed wiring board 222 or the winding 220.

Figure 25:
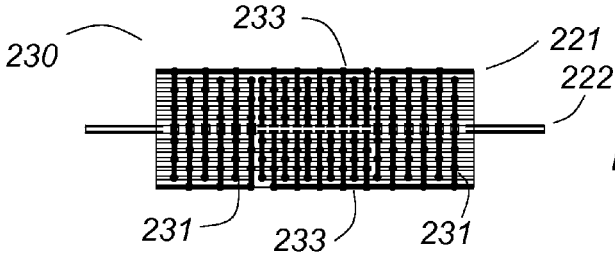
FIG. 25 shows plated vertical connections added to the interleaved common mode transformer of FIG. 24.

FIG. 25 is a representative end view of a common mode transformer winding 230 that comprises the stack of laminates 221 and the printed wiring board 222 of FIG. 24. Printed vertical conductors 233-233 are shown. It is not easy to picture how these vertical conductors 231-231 conform to the interconnections of a schematic, but that is understood by one skilled in the art of printed wiring layout. As a generality, alternate layers of the winding 230 are connected in parallel and brought to vias or surface mount pads on the printed wiring board 222. The alternate vertical conductors 231-231 also may be brought to heavy top and bottom surface heavy plated conductors 233-233. Note the gaps in the top and bottom conductors 233-233 so that there are not continuous conduction paths that would short the flux of the common mode transformer.

The vertical conductor pattern of FIG. 25 is optimized for bringing connections to the printed wiring board 222, to connect to components mounted thereon as is the usual practice.

Figure 26:
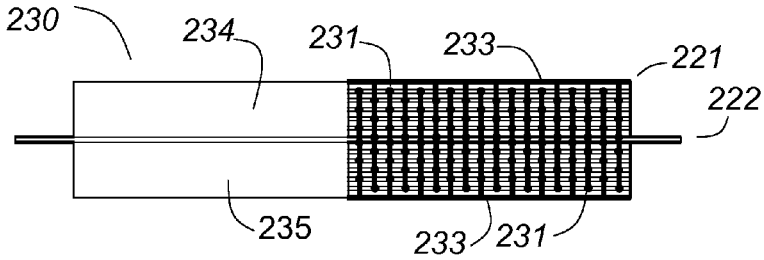
FIG. 26 shows a representative plating pattern for plated vertical connections for the side of the interleaved common mode transformer.

FIG. 26 is a representative side view of a common mode transformer winding 230 that comprises the stack of laminates 221 and the printed wiring board 222 of FIG. 24. As a generality, alternate conductive foils are connected by printed vertical conductors 231-231 to the top and bottom sides of the printed wiring board 222 and to top and bottom surface heavy plated conductors 233-233.

Figure 27:
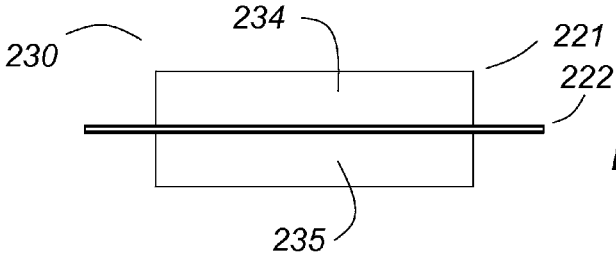
FIG. 27 shows that the plating on the vertical surfaces of the interleaved common mode transformer may be nearly continuous on the dc terminal end.

Note, however, that the left side of the winding 230 has unbroken plated surface conductors 234 and 235. If the surface conductors are continuous on the inside, the outside, the top and the bottom surfaces of the lamination stacks, the ac windings are entirely enclosed. FIG. 27 shows that the end of the winding 230 similarly has continuous surface plated conductors 234 and 235. With reference to FIG. 26, the right end is where the switches are located, for example, the switches 21 and 22 of FIG. 1. The left end is where the dc terminals are located, for example, the continuous surface plated conductor 234 may connect to the top surface of the printed wiring board 222 and may be a positive output terminal, and the continuous surface plated conductor 235 may connect to the bottom surface of the printed wiring board 222 and may be a negative output terminal.

As seen in FIGS. 13-16, 17-21 and 25-26, the layers of the winding connect in multiple places to the surface conductors and they may similarly connect to the continuous surface plated conductors 234 and 235 where the polarity is correct. Ac noise will tend not to penetrate the continuous surface plating if it is thicker than the penetration depth. However, it is noted that the penetration depth is not like an impenetrable wall, it is a mathematical construct. Ac currents penetrate into a conductor but are attenuated with depth, and are reduced about 63 percent at one penetration depth. The penetration depth being frequency dependent, and being smaller at higher frequencies, continuous plating will effectively shield very high frequency noise (emi) from the dc terminals. Some ac conduction would be possible on the surface, but the surrounding magnetic core effectively makes the outside surface a winding of an inductor, so noise conduction on the surface is significantly attenuated.

Schematically, there is no need to connect the ac winding (the lamination stack) to the dc winding (the continuous surface plating) as long as they are both connected to the common mode capacitors, the capacitors 6 and 7 of FIG. 1. This is a trade-off of individual designs. Connection only at the common mode capacitors truly separates the ac and dc windings, but it may be optimum to allow some commonality, particularly for heat transfer considerations. Also, at increasingly high frequencies, capacitive coupling to the inside surface will have decreasingly low impedance, so avoiding copper connections may not be important.

Another tradeoff involves the size of the common mode capacitors. In theory, they can be very small if a clean square-wave excitation is used, but larger ones may offer greater efficiency. Note that the ac currents and dc currents tend to superpose, though by separation of the ac winding and the dc winding, that is reduced. Still, when currents superpose and add, the losses are increased as the square of the sum of the currents. When they superpose and subtract, the losses are lower. In the analysis of FIGS. 2-3 and 6, equal dc currents are assumed, but an unequal distribution may be more efficient, and if there is sufficient capacity in the common mode capacitors, the currents may tend to divide differently and reduce losses.

It is said that currents will follow the path of least resistance, or impedance, in the case of ac currents. Analyzing the ac and dc currents separately, as in the discussions of FIGS. 2 through 7, may lead to the conclusion that each divides equally between the branches if their impedances are equal. However, when superposed, the sums are not equal, changing the equations. In transformers, circulating currents are usually bad, but analytically a current that tends to balance the net current flow may lead to lower losses. The charge on the common mode capacitors is the source of this current, and adequate capacitance is required if it is to be sustained through each half cycle of the ac switching frequency.

Figure 28:
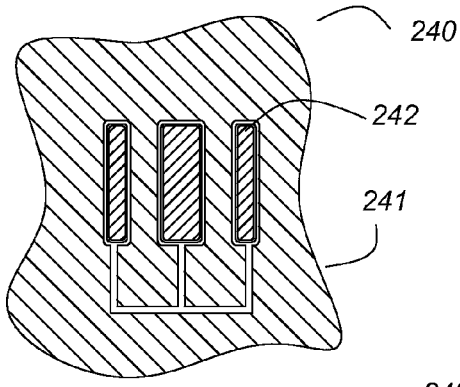
FIG. 28 shows a printed wiring board upon which a interleaved common mode transformer is built.
Figure 29:
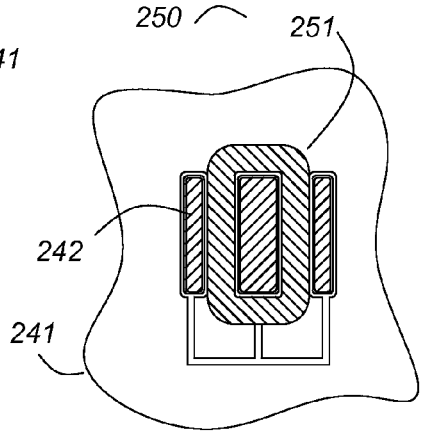
FIG. 29 shows the interleaved common mode transformer windings added to the printed wiring board of FIG. 28.

FIG. 28 shows a portion of transformer 240 of this invention. A printed wiring board 241 has cutouts therein to receive a transformer core 242. Note that the etched pattern defines areas 242 which will be the switch end of the transformer 240. Note that the areas 242 are extensions of a power plane through the transformer 240, and the same is true for a ground plane on the underside of the printed wiring board 241. The power and ground planes can be heavy copper for good electrical and heat conduction, supplemented by the surface plating that may be added later. FIG. 29 shows a portion of a transformer 250, which is the portion of a transformer 240 of FIG. 28 with the addition of a transformer winding 251. There may be a bottom transformer winding 252 on the reverse side, hidden.

Figure 30:
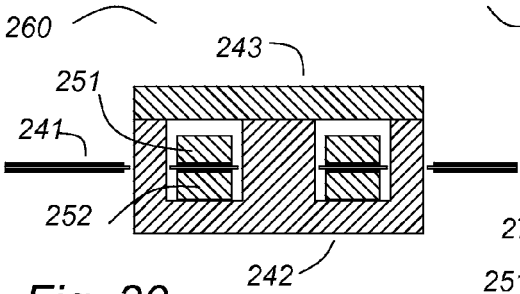
FIG. 30 is a section through the interleaved common mode transformer.

FIG. 30 shows a transformer 260, which is the portion of a transformer 250 of FIG. 29 in section, with the addition of a top 244 on the transformer core 243. Also, the bottom transformer winding 252 can be seen.

Figure 31:
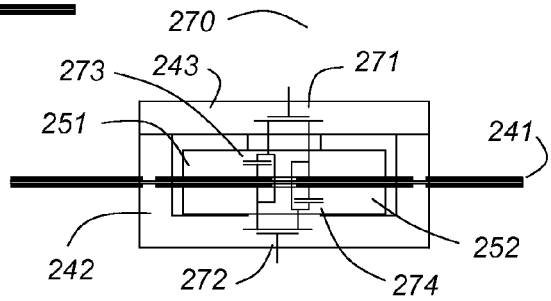
FIG. 31 is a pictorial schematic diagram showing components as symbols, but illustrating their physical connection to a interleaved common mode transformer.

FIG. 31 shows a semi-schematic end view of a transformer 270 which is the transformer 260 of with switches 271 and 272 and also with common mode capacitors 273 and 274. Common symbols are used for the switches 271 and 272 and the common mode capacitors 273 and 274 showing their electrical connection to the printed wiring board 241. FIG. 1 shows an equivalent schematic diagram. To minimize stray inductance in the interconnections, the connections to the common mode capacitors 273 and 274 are preferably very short and near the ends of the windings. For the same reason, the connections between the common mode capacitors 273 and 274 and the switches 271 and 272 are preferably very short. The schematic suggests their relative locations, further explained in FIGS. 32 and 33.

Figure 32:
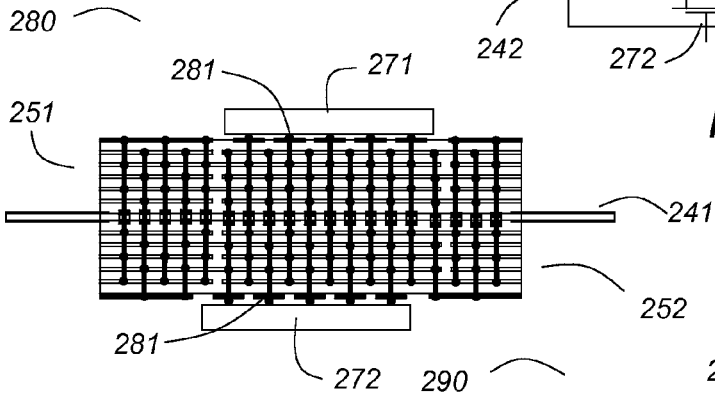
FIG. 32 shows plated vertical connections for the interleaved common mode transformer. Components may be mounted on the top and bottom of the windings.

FIG. 32 shows the winding 251 of the transformer of FIG. 31 with vertical conductors 281-281 shown. It is difficult to visualize the connections of the vertical conductors 281-281, but one skilled in printed wiring layout and transformers would understand how to make such vertical conductors without undue experimentation. The switches 271 and 272 are mounted respectively on the top and bottom surfaces of the winding 251, and the vertical conductors 281-281 are optimized for direct connection thereto.

Figure 33:
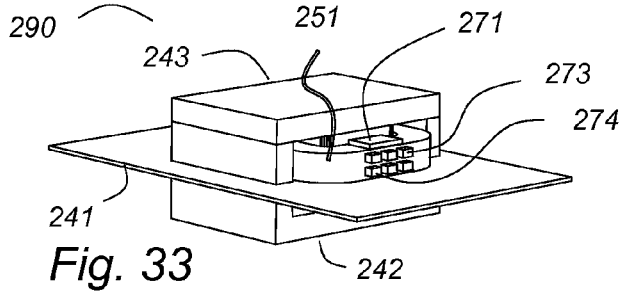
FIG. 33 shows a perspective view of the interleaved common mode transformer. Components are mounted on the transformer windings, for optimally short interconnections.

FIG. 33 shows a perspective view of a transformer 290, which is the transformer 270 of FIG. 31. Vertical conductors such as the vertical conductors 281-281 of FIG. 32 are understood but cannot be seen at the scale of FIG. 33. It can be seen that the switch 271 is on the top of the winding 251, and it is to be understood that the switch 272 (hidden, but visible in FIGS. 31 and 32) is is on the bottom of the winding 252 (hidden, but visible in FIGS. 31 and 32). It can also be seen that the common mode capacitors 273 and 274 may be mounted on the vertical surface of the winding 251 as chip capacitors, and additional common mode capacitors 273 and 274 may be mounded on the vertical surface of the winding 252 (hidden, but visible in FIGS. 31 and 32). The common mode capacitors 273 and 274 may comprise a plurality of chip capacitors for lower stray inductance.

If desired, there may be a second plated layer of copper over the switches 271 and 272 in the manner of FIG. 18. This may allow optimum connection to the drain connections of vertical MOSFETs, as an example, not a limitation. It may provide enhanced heat sinking, and it may provide emi shielding, depending upon the details of the design. The second plated layer of copper may or may not cove the common mode capacitors 273 and 274 as well, and there could be other components as well, possible logic and driver ICs for the switches 271 and 272, as an example, not a limitation.

Figure 34:
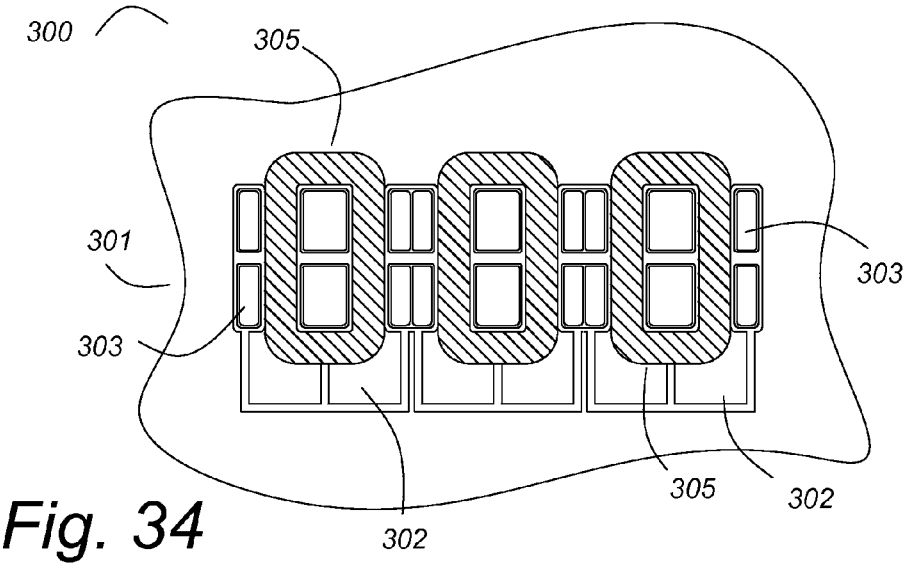
FIG. 34 shows that several transformers may be mounted close together on a printed wiring board. This may be used for a higher current, and the primary windings can be in series, with one set of derectifiers.

FIG. 34 shows a portion of a transformer 300 comprising a printed wiring board 301, a plurality of windings 305-305 mounted there on, the printed wiring board 301 having cutouts therein to receive a plurality of transformer cores 303-303. In FIG. 34, it is contemplated that the transformer 300 has a plurality of secondary windings contained within the windings 305-305 in parallel for greater current. There may be a primary winding contained within the windings 305-305 that is one continuous primary winding through the entire transformer 300, to ensure equal current in the plurality of windings 305-305 and to reduce the number of primary turns needed in each of the plurality of windings 305-305.

Figure 35:
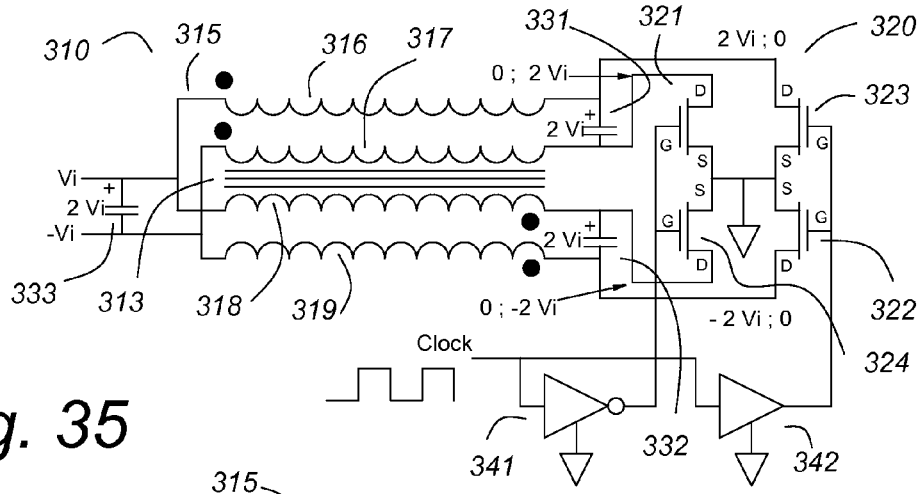
FIG. 35 shows a schematic diagram of an interleaved common mode transformer with a ground-referenced full-bridge derectifier.

FIG. 35 shows a primary circuit only for a transformer 310 of this invention. For a higher input voltage, it often is preferred to use a full-bridge derectifier and a full-bridge winding. A conventional full-bridge winding has the disadvantage of needing high and low side switches with high and low side switch drivers. These are not trivial and significantly complicate the design, but it does allow a simpler single winding for the primary of the transformer. FIG. 35 shows that with a printed wiring winding, a more complex primary winding 315 is easily accommodated, and allows a ground referenced full-bridge derectifier 320 to be used. The primary winding 315 comprises four windings 316-319 and connects on one end to an input voltage Vi and −Vi. There may also be an input filter capacitor 333. On the other end, the primary winding 315 connects to common mode capacitors 331 and 332, then to the derectifier 320, which comprises four switches 321-324, shown as an example, not a limitation, as MOSFETs. Note that the switches 321-324 have a common source connection at ground, assuming symmetrical +Vi and −Vi as the input voltage. (If the input is single ended, then the common reference for the derectifier 320 is the mid-point voltage). Being ground referenced, the switches 3321-324 may be driven by ground referenced drivers 341 and 342, shown schematically as logic gates. One skilled in the art of MOSFET drivers would be able to design suitable drivers to use this invention without undue experimentation.

Figure 36:
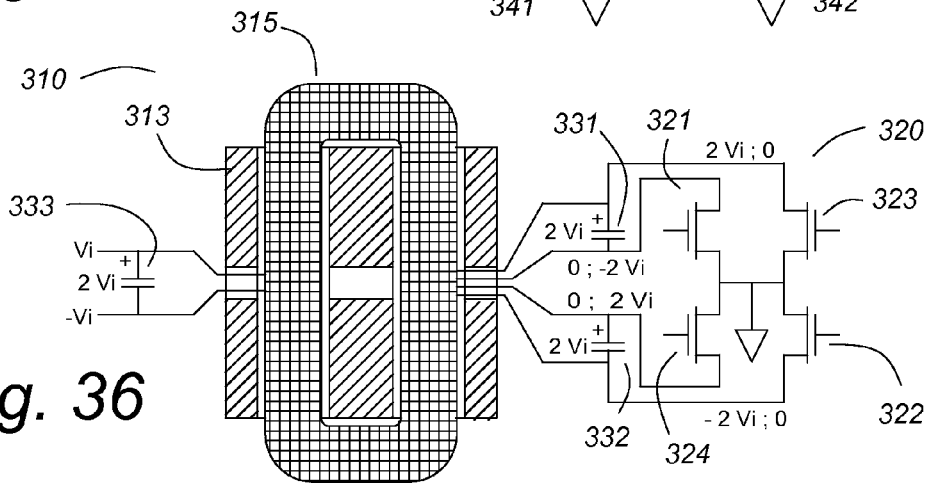
FIG. 36 shows a pictorial schematic diagram of the circuit of FIG. 35.

FIG. 36 shows a pictorial drawing of the same transformer 310 showing that the primary winding 315 may have its connection to the input power Vi and −Vi and to the common mode capacitors 331 and 332 and to the derectifier 320 through cutouts in the side of the transformer core 313. By passing through the side of the transformer core 313, there is significant common mode inductance for noise attenuation, but more important, the primary circuit is separated from the secondary circuits, which it is contemplated will be at the ends of the transformer 310.

Figure 37:
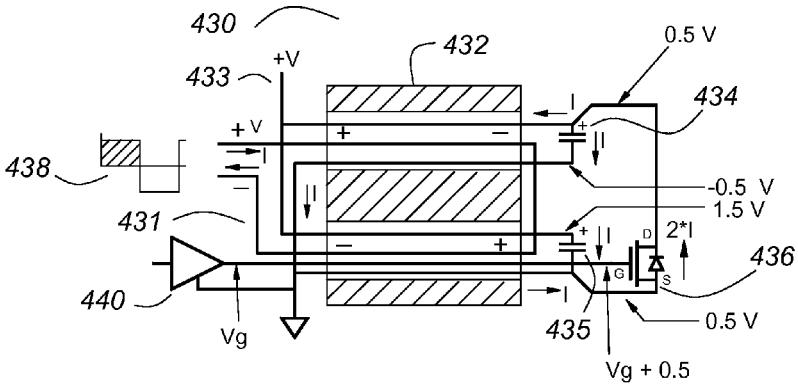
FIGS. 37 and 38 show ground referenced common mode MOSFET drivers.
Figure 38:
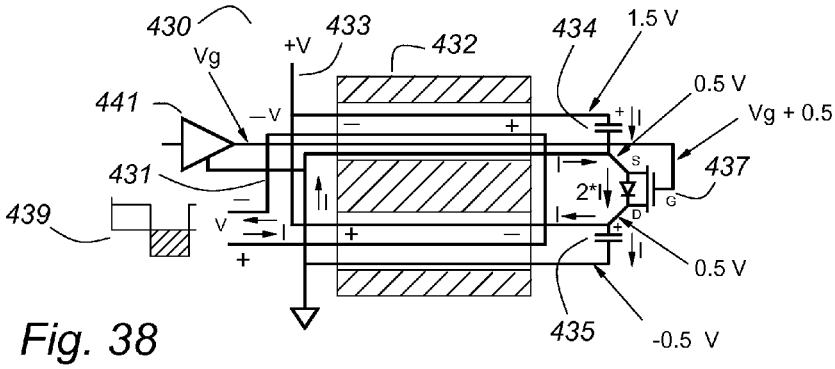

FIGS. 37 and 38 will be recognized as being quite similar to FIGS. 4 and 5, with some rearranging. FIGS. 37 and 38 show the same common mode transformer 430 as shown in FIGS. 2 and 3, with the addition of secondary switches 436 and 437, shown as MOSFETs, as an illustration, not a limitation. These switches 436 and 437 are analogous to the switches 21 and 22 of FIG. 1, and both are present but only the switch 436 or 437 that is turned on is shown respectively in FIGS. 37 and 38. There is no load, so there is no dc output current.

FIG. 37 shows a positive polarity of primary excitation, as shown by the small graph 438 and the + and − signs on the input of the primary winding 431. For positive excitation, the switch 436 is turned on, and the current flow is as shown. FIG. 38 shows negative polarity of primary excitation, and the switch 437 is turned on. For each polarity of excitation, the current flow is as shown by arrows, but the important point is that the current charging the common mode capacitors 434 and 435 is the same in FIGS. 37 and 38. The turned on switches 436 or 437 essentially place the common mode capacitors 434 and 435 in series, first in one order, then the other.

FIG. 37 also shows a gate driver 440. At the gate driver, when on as shown, its output drive voltage is Vg and it is referenced to ground. At the switch 436, the drive voltage is increased by the voltage induced by the flux to Vg+0.5 V, but the source voltage is also increased by the voltage induced by the flux to 0.5 V. Accordingly, the gate drive Vgs is Vg. This allows the gate driver to be ground referenced. It is possible that the gate driver should be located at the switch 436, but whatever logic device drives it can be ground referenced and the signal and its reference will be increased by the same amount as a common mode voltage.

FIG. 387 also shows a gate driver 441. At the gate driver, when on as shown, its output drive voltage is Vg and it is referenced to ground. At the switch 437, the drive voltage is increased by the voltage induced by the flux to Vg+0.5 V, but the source voltage is also increased by the voltage induced by the flux to 0.5 V. Accordingly, the gate drive Vgs is Vg. This allows the gate driver to be ground referenced. It is possible that the gate driver should be located at the switch 437, but whatever logic device drives it can be ground referenced and the signal and its reference will be increased by the same amount as a common mode voltage.

With the rapid switching, the windings of a transformer are a noisy environment, and the integrity of the common mode gate drive or logic signals could be compromised. However, if the top and bottom surfaces of the base printed wiring board are, respectively, the power plane and ground plane, with common mode capacitors attached at the switch end and an output filter capacitor attached at the output end, internal layers between the ground and power plane will be well shielded from the noise, enabling success with this method where it might not be with transformers conventionally constructed using windings or wires.

Another possible source of switching problems arises from the stray inductance of the source connection. While it is contemplated that the sources of the MOSFETs will be tightly connected to the ground plane, nonetheless any inductance in that circuit tends to buck the gate drive signal and can lead to oscillation. An inverting driver integral to the MOSFET reverses this situation, making any noise in the source lead regenerative.

The invention claimed is:

1. A common mode transformer comprising a transformer core and printed wiring windings comprising a primary winding comprising printed wiring primary turns and at least one secondary winding comprising printed wiring secondary turns, the printed wiring secondary turns comprising a highly interleaved ac secondary winding of thin conductors and a dc secondary winding in parallel with the ac secondary winding, the dc secondary winding comprising relatively thick conductors for low dc resistance and good heat sinking, the printed wiring windings further comprising at least a first deposited conductive layer on its vertical surfaces for making interconnections between turns of the printed wiring primary turns and for making interconnections between turns of the printed wiring secondary turns.

* * * * *